US008856972B2

(12) United States Patent
Kirshon

(10) Patent No.: US 8,856,972 B2
(45) Date of Patent: Oct. 14, 2014

(54) LIQUID-GEL IMPACT REACTION LINER

(76) Inventor: Jason Edward Kirshon, Cleverdale, NY (US)

( * ) Notice: Subject to any disclaimer, the term of this patent is extended or adjusted under 35 U.S.C. 154(b) by 243 days.

(21) Appl. No.: 12/928,804

(22) Filed: Dec. 20, 2010

(65) Prior Publication Data

US 2012/0151664 A1 Jun. 21, 2012

(51) Int. Cl.
*A42B 3/00* (2006.01)
*A42B 3/12* (2006.01)

(52) U.S. Cl.
CPC ..... *A42B 3/121* (2013.01)
USPC ..... 2/413

(58) Field of Classification Search
CPC ..... A42B 3/121; Y10S 2/909
USPC ..... 2/413, 411, 410, 414, 421
See application file for complete search history.

(56) References Cited

U.S. PATENT DOCUMENTS 3,039,109 A * 6/1962 Simpson ..... 2/413
3,600,714 A * 8/1971 Cade et al. ..... 2/83
3,994,022 A * 11/1976 Villari et al. ..... 2/413
4,586,200 A 5/1986 Poon
5,148,950 A 9/1992 Hosaka
5,669,079 A 9/1997 Morgan
6,117,176 A * 9/2000 Chen ..... 623/36
6,434,755 B1 * 8/2002 Halstead et al. ..... 2/414
6,493,881 B1 * 12/2002 Picotte ..... 2/413
6,865,759 B2 3/2005 Pearce
7,140,126 B2 11/2006 Crane et al.
2006/0075544 A1 * 4/2006 Kriesel et al. ..... 2/411
2008/0307569 A1 * 12/2008 Roberts ..... 2/456
2009/0158506 A1 6/2009 Thompson et al.

* cited by examiner

*Primary Examiner* — Khoa Huynh
*Assistant Examiner* — Anna Kinsaul
(74) *Attorney, Agent, or Firm* — Tech Valley Patent, LLC; John Pietrangelo

(57) ABSTRACT

The present invention relates generally to a helmet safety liner. More particularly, the invention encompasses a liquid-gel impact reaction liner for a motorcycle helmet. The present invention is also directed to a novel liquid-gel impact reaction liner for a half-shell motorcycle helmet. The inventive helmet could also have at least one cushion or intermediate layer which could be secured by one or more securing means.

27 Claims, 3 Drawing Sheets

LIQUID-GEL IMPACT REACTION LINER

FIELD OF THE INVENTION

The present invention relates generally to a helmet safety liner. More particularly, the invention encompasses a liquid-gel impact reaction liner for a motorcycle helmet. The present invention is also directed to a novel liquid-gel impact reaction liner for a half-shell motorcycle helmet. The inventive helmet could also have at least one cushion or intermediate layer which could be secured by one or more securing means.

BACKGROUND INFORMATION

The present invention relates to a safety enhanced motorcycle helmet. Helmets that are currently employed by drivers of motorcycles, and in other similar environments of use do not effectively absorb impact forces, nor do they properly decelerate and spread blows from the point of impact.

For some motorcycle helmets it has been found that motorcycle helmet foam liners are too stiff and hard and produce distortion or inbending of the head when an impact force is applied to the helmet. Their post-crash analysis and evaluation of helmets that have been in crashes involving impacts to the helmets revealed very little crushing of the foam liner of the helmet indicating that the density of the foam ought to be reduced.

In a study it was found that the human head deforms elastically on impact, and significant elastic deformation of the head can result in brain damage. Thus, it would be preferred to have a softer liner material in the helmet so that less deformation of the head occurs. As is known, that distortions of the human head beyond 1 to 2 mm can cause intracranial damage.

In a typical motorcycle helmet, the thickness of the shell of the helmet in the temple area of the user's head is about 4 mm, whereas the thickness of the foam liner is in the range of 12 to 30 mm. As is well known, the temporal area of the human skull is a zone of weakness. Bone tests have indicated that bone in the temporal region of the human head has only ½ to ⅓ the strength as compared to other areas of the human skull. Since a significant number of impacts occur in the temporal region, it is imperative that motorcycle helmets be designed to account for this fact.

In another study it was found that it would not be appropriate to design a motorcycle helmet employing a foam layer entirely of low density foam. Such a helmet liner would be too soft and resilient, would cause the helmet to move with respect to the user in an undesirable fashion, and it would also not be sufficiently durable to provide a reasonable useful life for the helmet.

The manufacturers of motorcycle helmet are constantly trying to improve the motorcycle helmet as more accident or material information becomes available. In this regards several manufacturers have address this issue in a variety of ways.

U.S. Pat. No. 4,586,200 (Melvyn C. Poon), the entire disclosure of which is incorporated herein by reference, discloses a protective crash helmet designed to increase the safety and comfort of a motorcycle rider is described. One of the protective layers inside the helmet includes inflatable air bubbles whose pressure and consequently size may vary when connected to an outside air pressure supply. This unique feature allows a more precise fit to a rider's head, all of which are not the same shape. In addition, the protective crash helmet also has a ventilating system for cooling the interior of the crash helmet. An air inlet located on the front of the helmet with a valving door, allows air inside the helmet whereby the passageway is the space between the respective air bubbles. The air outlet located in the rear of the helmet allows the air to pass through the helmet thereby cooling the rider.

U.S. Pat. No. 5,148,950 (Dave K. Hosaka), the entire disclosure of which is incorporated herein by reference, discloses embodiments of a helmet structure includes a separably movable fluid pouch mounted within the helmet below the forward helmet shell opening, including an "L" shaped conduit directed upwardly and mounted medially to a respective right and left fluid cavity of the reservoir structure. The organization utilizes hook and loop fastener tabs mounted to a forward surface of the right and left reservoirs for mounting to an interior fibrous surface of the helmet shell. A modification of the invention includes a storage tank mounted to the handle bar structure of an associated motorcycle or bicycle construction utilizing a storage tank conduit hose in communication with a valve mounted to the storage tank to direct fluid to the right and left reservoir pouches.

U.S. Pat. No. 5,669,079 (Don E. Morgan), the entire disclosure of which is incorporated herein by reference, discloses embodiments of a safety enhanced motorcycle helmet provide enhanced cushioning to protect sensitive areas of the user's head. In each embodiment, a high density foam material is provided just under the thick outer shell of the helmet. The various embodiments contemplate embedding of various designs of low density foam materials within the high density foam layer. Embodiments include strips of low density foam, low density cylindrical foam plugs, channels formed within the high density foam layer and containing low density foam balls, and low density foam wedge plugs.

U.S. Pat. No. 6,865,759 (Tony M. Pearce), the entire disclosure of which is incorporated herein by reference, discloses cushions and cushion elements with non-intersecting-columnar elastomeric members exhibiting compression instability are disclosed. The cushions and cushion elements may be made from gelatinous elastomer materials. The cushions and cushion elements have application in a variety of fields, including foot care products, seat cushions, mattresses and mattress overlays for consumer and medical applications, carry straps, sports injury prevention, orthopedics, vibration dampeners for electrical and electronic equipment, shock absorbers and others.

U.S. Pat. No. 7,140,126 (Laura Crane, et al.), the entire disclosure of which is incorporated herein by reference, discloses a removable insole for insertion into footwear, includes a lower layer made of a viscoelastic gel and including a lower surface, an upper surface, a toe portion, a heel portion and a medial arch portion interconnecting the toe portion and the heel portion, a first recess formed in the lower surface of the toe portion and a second recess formed in the lower surface of the heel portion, each recess having a peripheral side wall and a top wall, a plurality of thin, parallel, spaced apart sinusoidal wave shaped spring walls formed from the viscoelastic gel and connected to the top wall and the peripheral side wall in each recess, and the spring walls having lower edges generally coplanar with a lower surface of the toe portion and heel portion which is in surrounding relation to the respective recess; and a top cover secured to the upper surface of the lower layer.

U.S. Patent Publication No. 20090158506 (Matthew T. Thompson, et al.), the entire disclosure of which is incorporated herein by reference, discloses a helmet includes an outer shell, an energy-absorbing layer disposed inside the outer shell, and a liner disposed inside of the energy-absorbing layer. The liner includes a central portion configured to extend along a longitudinal axis that runs between a front portion of the helmet and a rear portion of the helmet, a first side portion releasably coupled to the central portion, and a second side portion releasably coupled to the central portion.

Therefore, there is a need for improvement in the field of motorcycle helmets, and in particular in the field of helmet safety liners.

This invention improves on the deficiencies of the prior art and provides an inventive liquid-gel impact reaction liner for a motorcycle helmet.

PURPOSES AND SUMMARY OF THE INVENTION

The invention is a novel liquid-gel impact reaction liner for a motorcycle helmet.

Therefore, one purpose of this invention is to provide a liquid-gel impact reaction liner for a motorcycle helmet.

Another purpose of this invention is to provide a reliable motorcycle helmet that has a liquid-gel impact liner, such that it distorts and changes the contours of its lining upon impact.

Yet another purpose of this invention is to provide a liquid-gel impact liner for a motorcycle helmet that is lightweight but robust to be able to take an impact.

Still another purpose of this invention is to provide a motorcycle helmet where the inventive liquid-gel impact liner will form fit differing shapes of user's head.

Still yet another purpose of this invention is to lower the center of gravity by bringing the percentage of weight closer to the user's skull.

Therefore, in one aspect this invention comprises a vehicle helmet having a helmet liner, comprising:

(a) a helmet shell, said helmet shell having an inner wall surface and an outer wall surface, and at least one first securing means to secure at least a portion of said helmet shell onto at least a portion of a head of a user;

(b) at least one flexible gel liner, said flexible gel liner comprising a first surface and a second surface, wherein said first surface is secured to said second surface to form a fluid sack layer, at least one through hole between said first surface and said second surface, and at least one gel material securely entrapped inside said fluid sack layer; and (c) at least one second means to secure at least a portion of said first surface to at least a portion of said inner wall surface, such that said second surface of said flexible gel liner faces said head of said user, and thereby forming said vehicle helmet having said helmet liner.

In another aspect this invention comprises a vehicle helmet having a helmet liner, comprising:

(a) a helmet shell, said helmet shell having an inner wall surface and an outer wall surface, and at least one first securing means to secure at least a portion of said helmet shell onto at least a portion of a head of a user;

(b) at least one flexible gel liner, said flexible gel liner comprising a first surface and a second surface, wherein said first surface is secured to said second surface to form a fluid sack layer, at least one through hole between said first surface and said second surface, and at least one gel material securely entrapped inside said fluid sack layer;

(c) at least one intermediate layer between said at least one flexible gel liner and said helmet shell, and (d) at least one second means to secure at least a portion of said at least one flexible gel liner to at least a portion of said at least one intermediate layer, and at least one third means to secure at least a portion of said at least one intermediate layer to at least a portion of said inner wall surface of said helmet shell, and thereby forming said vehicle helmet having said helmet liner.

BRIEF DESCRIPTION OF THE DRAWINGS

Although the scope of the present invention is much broader than any particular embodiment, a detailed description of the preferred embodiment follows together with drawings. These drawings are for illustration purposes only and are not drawn to scale. Like numbers represent like features and components in the drawings. The invention may best be understood by reference to the ensuing detailed description in conjunction with the drawings in which.

DETAILED DESCRIPTION

The invention is also directed to an energy absorption and displacement helmet liner, where a revolutionary technology provides greatest impact absorption and energy displacement, and in a most efficient amount of space. When used as a helmet liner, the liquid injected gel liner provides a perfectly molded fit, while adding to lowering the center of gravity to balance the helmet and improve performance and overall feel of the helmet. In addition to comfort, the impact reaction design of this invention incorporates an innovative, multi-stage, energy transference, displacement, and absorption system creating a multiple stage impact reaction sequence. This invention creates opportunities to make a better, safer, softer, helmet than ever before.

Figure 1:
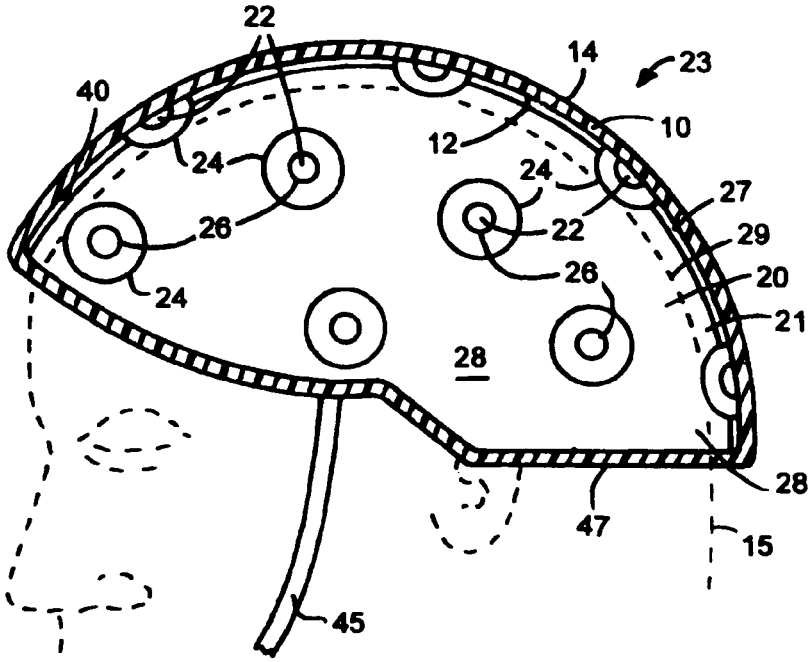
FIG. 1 is a cut-away side view of a first embodiment of the invention illustrating a helmet with a liquid-gel impact reaction liner.
Figure 5:
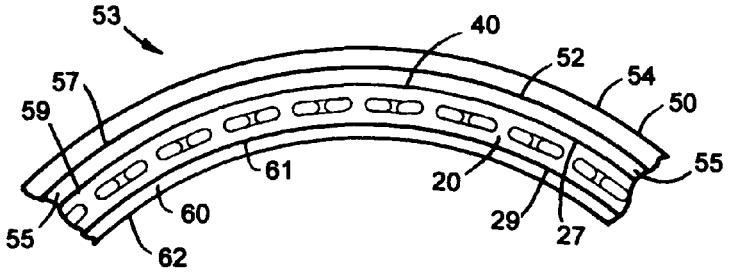
FIG. 5 is a cross-sectional cut-away view of a third embodiment of the invention illustrating a helmet with a liquid-gel impact reaction liner, and at least one intermediate layer.

FIG. 1 is a cut-away side view of a first embodiment of the invention, illustrating a helmet with liquid-gel impact reaction liner 23, of this invention. The helmet with liner 23, comprises of a helmet shell 10, with a peripheral edge 47, having a helmet inner wall 12, and a helmet outer wall 14, and a liquid-gel impact reaction liner 20. The liquid-gel impact reaction liner 20, has a gel-liner outer wall 27, and a gel-liner inner wall 29, as more clearly seen in FIG. 3. It is preferred that the liquid-gel impact reaction liner 20, is along the surface of the helmet inner wall 12. The liquid-gel impact reaction liner 20, could be form-fitted inside the helmet 10, or it could be secured to the helmet inner wall 12, via various means, such as, for example, an adhesive, a glue, an epoxy, rivets, to name a few. The liquid-gel impact reaction liner 20, has a fluid sack layer 21, containing fluid 28. The fluid sack also has a plurality of holes or openings 22, that are surrounded by a liner opening inner wall 26, and a liner opening outer wall 24, so as to create a doughnut shaped hole or opening 22. The fluid sack layer 21, is made from a material that can securely accommodate the fluid or gel 28, but have elasticity to allow the expansion or contraction of the donut hole 22. The gel-liner outer wall 27, of the liquid-gel impact reaction liner 20, is preferably secured to at least a portion of the inner wall 12, of the helmet 10, via at least one layer of a securing means 40. Depending upon the application the securing means 40, could be a continuous layer 40, as shown in FIG. 5, or it could be an spot or discrete layer 40, which is placed at strategic locations, as shown in FIG. 1. The helmet shell 10, illustrated in FIG. 1, is considered a "half shell" helmet 10, in the motorcycle world. The helmet 10, could have one or more straps 45, that could go around the chin of a user 15, that would secure the helmet shell 10, to the head of the user 15.

Figure 2:
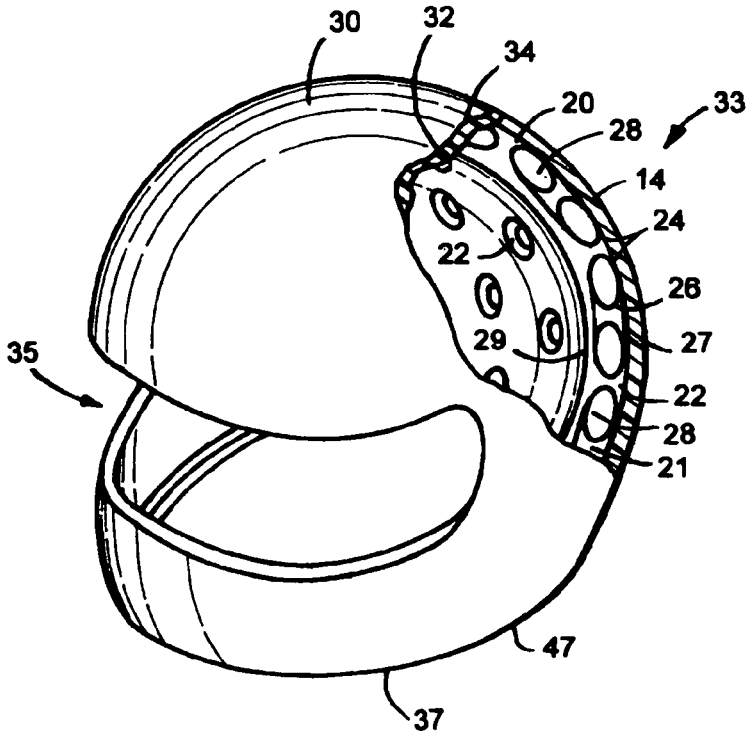
FIG. 2 is a perspective cut-away view of a second embodiment of the invention illustrating a helmet with a liquid-gel impact reaction liner.

FIG. 2 is a perspective cut-away view of a second embodiment of the invention, illustrating a helmet with liquid-gel impact reaction liner 33, of this invention. The helmet with liner 33, comprises of a helmet shell 30, with a peripheral edge 47, having a helmet inner wall 32, and a helmet outer wall 34, and a liquid-gel impact reaction liner 20. The liquid-gel impact reaction liner 20, has a gel-liner outer wall 27, and a gel-liner inner wall 29, as more clearly seen in FIG. 3. It is preferred that the liquid-gel impact reaction liner 20, is along the surface of the helmet inner wall 32. The liquid-gel impact reaction liner 20, could be form-fitted inside the helmet 30, and/or it could be secured to the helmet inner wall 32, via various means, such as, for example, a silicone, an adhesive, a glue, an epoxy, rivets, to name a few. The liquid-gel impact reaction liner 20, has a fluid sack layer 21, containing fluid 28. The fluid sack also has a plurality of holes or openings 22, that are surrounded by a liner opening inner wall or inner sack wall 26, and a liner opening outer wall or outer sack wall 24, so as to create a doughnut shaped hole or opening 22. The fluid sack layer 21, is made from a material that can securely accommodate the fluid or gel 28, but be flexible to allow the expansion or contraction of the donut hole 22. The helmet shell 30, illustrated in FIG. 2, is considered a "full shell" helmet 30, in the motorcycle world. The helmet shell 30, could have one or more straps 45, (not shown) that could go around the chin of a user 15, that would secure the helmet shell 30, to the head of the user 15. The helmet shell 30, also has at least one front opening 35, for the face of the user 15, and a bottom opening 37, around the peripheral edges 47, for the passage of the head of the user 15.

Figure 3:
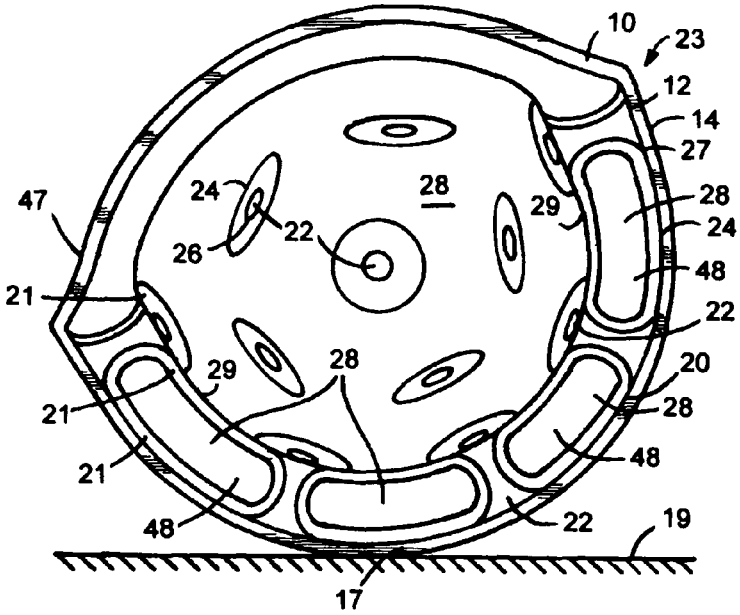
FIG. 3 is a cut-away rear view of the first embodiment showing the helmet in an instant just prior to a crash.

FIG. 3 is a cut-away rear view of the first embodiment showing the helmet with liquid-gel impact reaction liner 23, in an instant just prior to a crash, along a surface 19, and at the point of contact 17. As shown in FIGS. 1 and 2, the gel-liner outer wall 27, is along the surface of the helmet inner wall 12, of the helmet shell 10, while the gel-liner inner wall 29, is along the peripheral head surface of the user 15. It should be appreciated that for some applications one could have one or more additional liners (not shown). As one can see in FIG. 3, that the fluid or gel sack 48, containing the fluid or gel 28, has a pretty consistent and uniform shape just prior to the impact or crash, this is due to the fact that fluid sack 21, containing the gel material 28, and the plurality of openings or donut holes 22, are uniformly positioned and secured around the peripheral head surface of the user 15, prior to any impact or crash.

Figure 4:
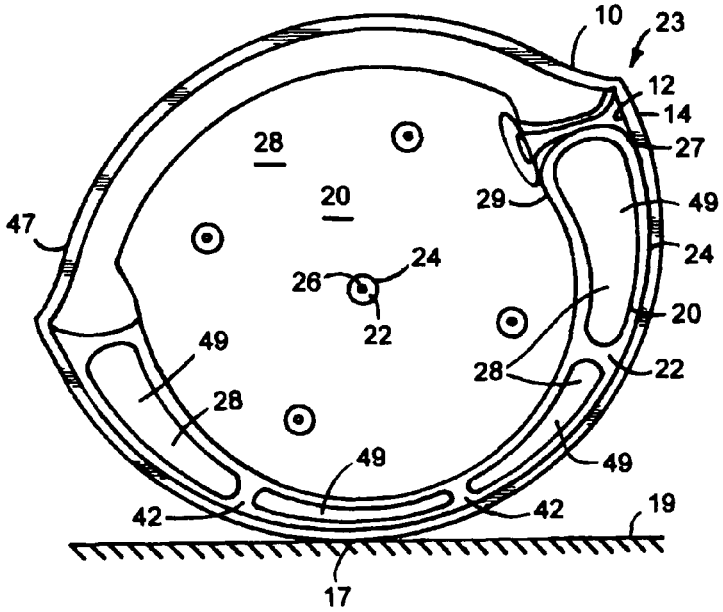
FIG. 4 is a cut-away rear view of the first embodiment showing the helmet in the reaction stage an instant after initial impact of the crash.

FIG. 4 is a cut-away rear view of the first embodiment showing the helmet 23, in the reaction stage an instant after initial impact of the crash. As one can now see in FIGS. 3 and 4, that upon impact or crash, the first reaction of the liquid-gel impact reaction liner 20, is to allow the liquid or fluid or gel 28, inside the gel casing or fluid sack layer 21, to travel away from the impact zone at a rapid pace. This movement of the fluid 28, away from the impact zone increases the volume displacement in surrounding connected chambers. This movement of the fluid 28, inside the gel casing or fluid sack layer 21, displaces the square inches of contact to as big as an area as possible, exponentially dividing the energy of the impact evenly through the entire helmet 10, and thus fluid or gel sack shape 49, containing the fluid or gel 28, changes just after impact, as the gel distributes the incoming energy, due to the impact or crash, to other locations within the fluid sack layer 21. This distribution of impact energy reduces the trauma to the head of the user 15, while distributing and dissipating the impact energy from the impact or crash. This distribution of impact energy is achieved in several ways, such as, for example, having the openings 22, elastically reduce their size near the impact zone, while expanding the size of the opening 22, at locations further away from the impact zone, as clearly seen in FIG. 4, in the shapes of the gel or fluid sack shape 49, containing the fluid or gel 28, at various locations near and away from the point of impact 17. It is preferred that the compression chambers that are formed between the donut hole openings 22, are laid out in a staggered formation. This allows the liquid or gel or fluid 28, to flow rapidly on a woven like course away from point of original impact 17, over the surface 19. This displaces the kinetic energy that the liquid-gel impact reaction liner 20, has begun to absorb. As one can see at the point of impact 17, the liquid containment chambers contract due to the dispersion of the liquid 28, during this stage, this is more clearly seen when one observes that the hole or opening 42, and the shapes of the gel or fluid sack 49, containing the fluid or gel 28, have changed shape compared to the shape of the previous fluid or gel sack 48, containing the fluid or gel 28, around the hole or opening 22. As one can see at the point of impact 17, the compression chambers are compressing the fluid sack layer 21, so as to expand the fluid sack layer 21, and reduce the size of the donut hole 22, at the point closest to the impact zone 17, while the size of the donut hole 22, contracts at other locations, away from the point of impact 17, as fluid 28, has moved to those locations. The liquid or gel 28, reacts by traveling away from impact zone 17, at a rapid pace evenly, and in all different directions, within the fluid sack layer 21, due to the displacement and distribution of the liquid or gel 28.

FIG. 5 is a cross-sectional cut-away view of a third embodiment of the inventive helmet with liquid-gel impact reaction liner 53, illustrating a helmet shell 50, with a liquid-gel impact reaction liner 20, and at least one intermediate layer 55. The inventive helmet shell 50, has an inner shell wall 52, and an outer shell wall 54. The at least one intermediate layer 55, has an outer wall 57, and an inner wall 59. For some applications the inner shell wall 52, of the helmet 50, is secured to at least a portion of the outer wall 57, of the intermediate layer 55. The gel-liner outer wall 27, of the liquid-gel impact reaction liner 20, is then preferably secured to at least a portion of the inner wall 59, of the intermediate layer 55, via at least one layer of a securing means 40. It should be understood that the securing means 40, could be between the helmet shell 50, and the intermediate layer 55, (not shown) and/or between the intermediate layer 55, and the liquid-gel impact reaction liner 20, as shown in FIG. 5. Depending upon the application the securing means 40, could be a continuous layer 40, as shown in FIG. 5, or it could be an spot layer 40, which is placed at strategic locations, as shown in FIG. 1. Optionally, the inventive helmet 23, could also have one or more cushion layer 60, having an outer cushion wall 61, and an inner cushion wall 62. The cushion layer 60, could be placed as desired by the user and/or manufacturer, such as, between the helmet shell 50, and the intermediate layer 55, and/or the intermediate layer 55, and the liquid-gel impact reaction liner 20, and/or the liquid-gel impact reaction liner 20, and the head of the user 15, to name a few locations.

Figure 6A:
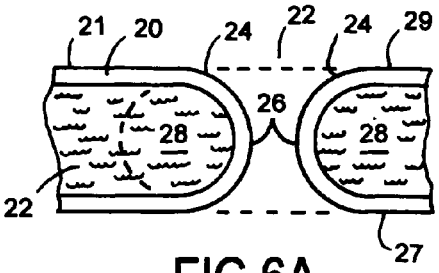
FIG. 6A is an exploded cut-away side view of a first embodiment of the inventive liquid-gel impact reaction liner of this invention.

FIG. 6A is an exploded cut-away side view of a first embodiment of the inventive liquid-gel impact reaction liner 20, of this invention. The liquid-gel impact reaction liner 20, comprises a fluid sack layer 21, comprising one or more openings 22, a gel-liner outer wall 27, and a gel-liner inner wall 29. The opening 22, creates a liner opening outer wall 24, and a liner opening inner wall 26. In FIG. 6A, the liner wall opening 22, is shown as having a semi-circular or semi-elliptical shape. The fluid sack layer 21, preferably contains at least one fluid 28.

Figure 6B:
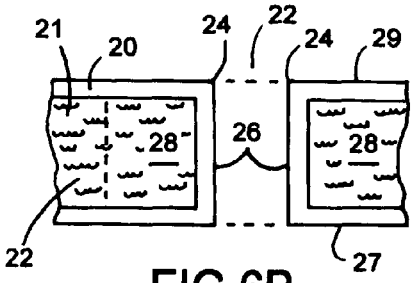
FIG. 6B is an exploded cut-away side view of a second embodiment of the inventive liquid-gel impact reaction liner of this invention.

FIG. 6B is an exploded cut-away side view of a second embodiment of the inventive liquid-gel impact reaction liner 20, of this invention. The liquid-gel impact reaction liner 20, comprises a fluid sack layer 21, comprising one or more openings 22, a gel-liner outer wall 27, and a gel-liner inner wall 29. The opening 22, creates a liner opening outer wall 24, and a liner opening inner wall 26. In FIG. 6B, the liner wall opening 22, is shown as having substantially straight wall shape. The fluid sack layer 21, preferably contains at least one fluid 28.

The liquid-gel impact reaction liner 20, could be secured to the helmet inner wall 12, 32, of the helmet shell 10, 30, using at least one securing means 40. The securing means 40, could be selected from a group comprising of a glue, an adhesive, an adhesive type tape, an adhesive type strip, a hook and loop type fastening means, hooks, snaps, ties, strings, a silicone adhesive, to name a few.

The helmet shell 10, 30, could be provided with at least one securing means 45, to securely secure the helmet shell 10, 30, to the head of the user 15. The securing means 45, could be selected from a group comprising a strap, an adjustable strap, a strap having at least one buckle, a strap having at least one hook and loop type fastening means, to name a few.

It should be appreciated that the inventive gel liner 20, is constructed in such a manner to match curvature of the helmet so that it will fit into the helmet shell 10, 30, that it is designed for. The size and the number of compression zones 25, may be adjusted to best suit the helmet purpose, it's intended for, by design.

The materials used to construct liquid-gel impact reaction liner 20, can vary. The fluid sack layer or casing 21, comprising the gel-liner outer wall 27, gel-liner inner wall 29, and opening 22, preferably are made of a rigid material that is also elastic, such as, for example, a synthetic impact gel, a soy based impact gel, to name a few. The wall thickness of the gel liner 20, can be adjusted to suit the needs of the helmet 10, 30, that it is designed for. The thicker the wall material, the greater the final stage of absorption will be, however, if it is too stiff or hard then it will contribute to head trauma in a crash impact.

The liquid or fluid 28, that is used for the liner 20, can vary in viscosity. Similarly, the thickness of the liquid or fluid 28, can be adjusted or tuned for speed of reaction time and/or stages. One or more liquid or fluid 28, that can be used within the fluid sack layer 21, could be a non-toxic, high viscosity, liquid, such as, for example, Propylene Glycol. It should be appreciated that Propylene Glycol has antifreeze qualities, which would benefit cold temperature exposure and retention. It is also preferred that the gel be a thicker liquid so as to quickly absorb and dissipate the impact energy.

The liquid or fluid gel layer 28, could be made from a non-foam elastomer 28, such as the class of materials known as viscoelastic polymers or silicone gels, which show high levels of damping when tested by dynamic mechanical analysis performed in the range of −50 degrees C. to 100 degrees C. Because the mechanical properties of the gel 28, can be more viscous than elastic, the gel 28, can provides a high level of energy absorption. Some of the gels 28, that can be used according to the present invention can be thermoplastic elastomers (elastomeric materials), such as, materials made from many polymeric families, including but not limited to the Kraton family of styrene-olefin-rubber block copolymers, thermoplastic polyurethanes, thermoplastic poly olefins, polyamides, polyureas, polyesters and other polymer materials that reversibly soften as a function of temperature. One such elastomer is a Kraton block copolymer of styrene/ethylene-co-butylene/styrene or styrene/butadiene/styrene with mineral oil incorporated into the matrix as a plasticizer.

The fluid sack layer 21, can be made from any suitable layer material 21, such as, for example, fabric, leather, leatherboard, expanded vinyl foam, flocked vinyl film, coagulated polyurethane, latex foam on scrim, supported polyurethane foam, laminated polyurethane film or in-mold coatings such as polyurethane, styrene-butadiene-rubber, acrylonitrile-butadiene, acrylonitrile terpolymers and copolymers, vinyls, or other acrylics, to name a few. Desirable characteristics of the fluid sack layer 21, includes, good durability, stability, and visual appearance. It is preferred that the material of the fluid sack layer 21, have good flexibility, as indicated by a low modulus, in order to be easily moldable and flexible.

It is preferred that the fluid sack layer 21, be made from a soft elastomeric material, including gelatinous elastomers, and those cushioning materials that operate according to a principle of compression instability. The material for the fluid sack layer 21, could be any elastomeric material which tends to compress under a load, and can provide cushioning upon impact. Such materials include natural and synthetic rubbers, foams, thermoplastic elastomers, polyurethane elastomers, silicone elastomers, polyvinyl chloride (PVC) elastomers, olefinic elastomers, polyamide elastomers, gelatinous elastomers which are substantially non-flowable at room temperature (below 130 degrees Fahrenheit), to name a few.

The material for the at least one intermediate layer 55, could be selected from a group comprising, synthetic rubber, foams, thermoplastic elastomers, polyurethane elastomers, silicone elastomers, polyvinyl chloride (PVC) elastomers, olefinic elastomers, polyamide elastomers, gelatinous elastomers which are substantially non-flowable at room temperature (below 130 degrees Fahrenheit), expanded polystyrene (EPS), to name a few.

It is highly desirable that the liquid-gel impact reaction liner 20, of this invention be capable for providing cushioning, pressure relieving, shear relieving, shock absorbing, vibration attenuating, or energy returning cushioning, upon impact.

It should be appreciated that this invention provides a motorcycle helmet having a lower center of gravity, as the inventive liquid-gel impact liner brings the hard helmet shell closer to the user's head. Furthermore, this invention also lowers the center of gravity by bringing the percentage of weight closer to the user's skull, and reducing surface area exposed to wind and elements.

It is understood that this impact technology would be used in several other types of helmets and/is body armor configurations. It should also be appreciated that the helmet apparatus of this invention reacts to point of impact and displaces the impact to as large a surface area as possible, thus substantially reducing the stresses created at the point of impact.

The liquid gel inside the gel sack will react differently depending on the speed of the impact, for example, the faster the impact, the stiffer the fluid becomes, and vice versa. According to case studies on motorcycle crashes, preventing concussions, a serious and common, and preventable occurrence in a higher percentage of crashes, needs to be addressed when designing a motorcycle helmet. The inventive motorcycle helmet of this invention accomplishes this with the use of a better, and a softer gel-liner.

The fluid or gel 28, could also be an energy absorbing polymeric compound 28, and which may be comprised of most any polymeric gel 28. The gel or fluid 28, incorporated inside the fluid or gel sack 21, is preferably both viscoelastic and shock-attenuating.

An example of a gel compound 28, is one that comprises an epoxidized vegetable oil combined with a prepolymer and a thermoplastic polymer. Additionally, a catalyst or an accelerant may also be added to the energy absorbing compound 28, to aid in the formation of the compound 28. Typically, the activator or accelerant is a metal activator, such as, an alkyl tin compound.

It is within the scope of the present invention to incorporate other additives, such as, fillers, pigments, surfactants, plasticizers, organic blowing agents, as stabilizers, and the like, in the manufacture of the fluid sack 21, which is basically a reinforced polymeric shock absorbing envelope 21.

While the present invention has been particularly described in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

What is claimed is:

1. A helmet comprising: a helmet shell, said helmet shell having an inner wall surface and an outer wall surface; and at least one flexible liner, said flexible liner comprising a first surface facing said inner wall surface of said helmet shell and a second surface facing a head of a user, wherein said first surface is secured to said second surface to form a completely sealed fluid sack layer comprising a continuous compartment, a plurality of through holes extending between said first surface and said second surface, at least three of the plurality of through holes radially spaced from an apex of the liner to a periphery of the liner, and a liquid securely entrapped inside said continuous compartment, and wherein said liquid is free to freely move inside said continuous compartment of said at least one flexible liner.

2. The helmet of claim 1, wherein said liquid comprises a material is selected from a group consisting of thermoplastic elastomers, elastomeric materials, polymeric materials, styrene-olefin-rubber block copolymers, thermoplastic polyurethanes, thermoplastic poly olefins, polyamides, polyureas, polyesters, silicone gels, polymeric gels, synthetic gels, soy based gels, polymer materials that reversibly soften as a function of temperature, a copolymer of styrene/ethylene-co-butylene/styrene, and a styrene/butadiene/styrene with mineral oil incorporated into the matrix as a plasticizer.

3. The helmet of claim 1, wherein material for said fluid sack layer is selected from a group consisting of fabric, leather, leatherboard, expanded vinyl foam, flocked vinyl film, coagulated polyurethane, latex foam on scrim, supported polyurethane foam, laminated polyurethane film, polyurethane, styrene-butadiene-rubber, acrylonitrile-butadiene, acrylonitrile terpolymers and copolymers, vinyls, acrylics, a soft elastomeric material, a gelatinous elastomers, a natural rubber, a synthetic rubber, foam, thermoplastic elastomer, polyurethane elastomer, silicone elastomer, polyvinyl chloride (PVC) elastomer, olefinic elastomer, polyamide elastomer, and gelatinous elastomer.

4. The helmet of claim 1, wherein each of said plurality of through holes comprises an inner wall, and wherein at least a portion of each of said plurality of through holes inner wall forms a curved inner wall surface between said first surface and said second surface.

5. The helmet of claim 1, wherein each of said plurality of through holes is adapted to shrink under pressure, while said fluid sack is adapted to expand under pressure.

6. The helmet of claim 1, further comprising at least one cushion intermediate layer secured to said inner wall surface of said helmet shell.

7. The helmet of claim 1, wherein each of said plurality of through holes has a first cross-sectional shape prior to impact, and a second cross-sectional shape different from the first cross-sectional shape upon impact.

8. The helmet of claim 1, wherein each of said plurality of through holes has a cross-sectional shape prior to impact, and a second cross-sectional shape different from the first cross-sectional shape upon impact, and wherein said second cross-sectional shape is smaller than said first cross-sectional shape.

9. The helmet of claim 1, wherein each of said plurality of through holes is uniformly positioned around said at least one flexible liner.

10. A method of forming a helmet having an impact reaction liner, the method comprising:

(a) forming a flexible liner, wherein said flexible liner comprises a first surface and a second surface, and wherein said first surface is secured to said second surface to form a completely sealed fluid sack layer comprising a continuous compartment, and wherein said flexible liner further comprises a plurality of through holes extending between said first surface and said second surface, at least three of the plurality of through holes radially spaced from an apex of the liner to a periphery of the liner, and wherein a liquid is entrapped inside said continuous compartment, and wherein said liquid is free to freely move inside said continuous compartment; and (b) securing at least a portion of one of the first or second surface of said flexibl liner within an inner wall surface of a helmet shell, and thereby forming said helmet having the impact reaction liner.

11. In combination with a helmet, a helmet liner secured within an inner surface of said helmet for protection of a wearer against impact, said helmet liner comprising a flexible liner, said flexible liner comprising a first surface and a second surface, wherein said first surface is secured to said second surface to form a completely sealed fluid sack layer comprising a continuous compartment, a plurality of through holes extending between said first surface and said second surface, at least three of the plurality of through holes radially spaced from an apex of the liner to a periphery of the liner, and a liquid entrapped inside said continuous compartment, and wherein said liquid is free to freely move inside said continuous compartment; and, upon an impact, said liquid is adapted to move away from a location of said impact, and wherein each of the plurality of through holes is adapted to contract to accommodate said movement of said liquid.

12. The helmet of claim 1, wherein the continuous compartment comprises a continuous chamber extending from a front to a back of the helmet.

13. The helmet of claim 1, wherein the continuous compartment comprises a continuous chamber extending between sides of the helmet.

14. The helmet of claim 1, wherein the liquid comprises a variable viscosity liquid.

15. The helmet of claim 1, wherein the liquid comprises propylene glycol.

16. The helmet of claim 1, wherein the at least one flexible liner comprises one of a synthetic impact gel and a soy-based impact gel.

17. The helmet of claim 1, wherein the plurality of through holes comprise circular through holes.

18. The method of claim 10, wherein the plurality of through holes comprise circular through holes.

19. The helmet liner of claim 11, wherein the plurality of through holes comprise circular through holes.

20. The helmet of claim 1, wherein the first surface of the flexible liner is secured within said inner wall surface of said helmet shell by at least one of an adhesive, a glue, an epoxy, and rivets.

21. The helmet of claim 1, wherein said helmet shell is selected from a group consisting of a half shell helmet and a full shell helmet.

22. The helmet of claim 21, wherein said full shell helmet has at least one opening for the visibility of said user.

23. The helmet of claim 1, wherein each of said plurality of through holes comprises an inner wall, and wherein at least a portion of each of said plurality of through holes inner wall forms a substantially straight inner wall surface between said first surface and said second surface.

24. The helmet of claim 6, wherein material for said at least one cushion intermediate layer is selected from a group consisting of synthetic rubbers, foams, thermoplastic elastomers, polyurethane elastomers, silicone elastomers, polyvinyl chloride (PVC) elastomers, olefinic elastomers, polyamide elastomers, gelatinous elastomers which are substantially non-flowable at room temperature (below 130 degrees Fahrenheit), and expanded polystyrene (EPS).

25. The helmet of claim 1, wherein at least a portion of said helmet shell is configured to be secured onto at least a portion of a head of a user by at least one of a strap, an adjustable strap, a strap having at least one buckle, and a strap having at least one hook and loop type fastening.

26. The helmet of claim 6, wherein at least a portion of said at least one flexible liner is secured to at least a portion of said at least one cushion intermediate layer by at least one of a glue, an adhesive, an adhesive type tape, an adhesive type strip, a hook and loop type fastening, hooks, snaps, ties, and strings.

27. The helmet of claim 6, wherein at least a portion of said at least one cushion intermediate layer is secured to at least a portion of said inner wall surface of said helmet shell by at least one of a glue, an adhesive, an adhesive type tape, an adhesive type strip, a hook and loop type fastening, hooks, snaps, ties, and strings.

* * * * *